United States Patent [19]

Crandall

[11] Patent Number: 4,937,964

[45] Date of Patent: Jul. 3, 1990

[54] TWO-STAGE TRIGGERED ADAPTER

[76] Inventor: David L. Crandall, 10425 N. Dorian Ave., Idaho Falls, Id. 83401

[21] Appl. No.: 434,862

[22] Filed: Nov. 7, 1989

[51] Int. Cl.[5] ..... F41A 19/16

[52] U.S. Cl. ..... 42/69.03

[58] Field of Search ..... 42/41, 65, 69.01, 69.02, 42/69.03

[56] References Cited

U.S. PATENT DOCUMENTS 810,177 1/1906 Turudija .
3,183,616 5/1965 Gandy .
4,730,406 3/1988 Forbes et al. ..... 42/70

FOREIGN PATENT DOCUMENTS 2499707 8/1982 France ..... 42/69.01
2619440 2/1989 France ..... 42/69.01

*Primary Examiner*—Charles T. Jordan
*Assistant Examiner*—Richard W. Wendtland
*Attorney, Agent, or Firm*—Hopkins, French, Crockett, Springer & Hoopes

[57] ABSTRACT

An adapter for a single-stage trigger weapon which converts the trigger system from a single-stage trigger with a constant trigger pull force to a two-stage trigger pull system, wherein the required second-stage pull force is perceptibly greater than the required first-stage pull force. The increase in the trigger pull force occurs immediately prior to hammer release and provides the shooter with an indication of imminent weapon discharge. The adapter pivots about a fulcrum between the first and second stages.

10 Claims, 24 Drawing Sheets

TWO-STAGE TRIGGERED ADAPTER

BACKGROUND OF THE INVENTION

This invention relates to an adapter for installation in an AR-15 or M16-type rifle to change a one-stage trigger system to a two-stage trigger system. A two-stage trigger system eliminates what is commonly known as "creep" after initial take-up of trigger movement and gives the shooter an indication of eminent firing immediately prior to firing.

In a single-stage trigger system the trigger force is dependent on two disparate forces. The first is the torsional trigger spring force occurring due to rotation of the trigger about its pivot point, creating increased torque on the trigger spring that presses on the lower receiver. The second force is that due to frictional engagement between the trigger sear surface and the mating hammer sear surface, which are slidably engaged when the hammer is in the cocked position. The sear surface friction results from a torsional hammer spring that provides a rotational force to the hammer, which is restrained at the sear surfaces until the trigger releases the hammer. Typical weapons of the type disclosed herein provide a relatively uniform or constant trigger force of between 5 and 9 pounds during the discernible movement of the trigger prior to firing. While the apparatus of the present invention is set forth herein in conjunction with an AR-15 or M16 manufactured by Colt Industries, it is to be understood that the invention is useful in adapting any single-stage trigger assembly of similar automatic or semi-automatic weapons to a two-stage trigger. As used herein, the term "single-stage trigger" refers to a trigger having a constant trigger pull force, whereas a "two-stage trigger" has first and second stages with different trigger pull forces, the second typically being greater than the first. The AR-15 Sporter rifle has been offered for civilian sale in a semi-automatic-only configuration. The AR-15 Sporter is mechanically similar to the M-16, except that the necessary features to produce fully-automatic fire have been deleted, and the trigger housing modified to prevent conversion to automatic fire.

Many military weapons since 1900 have utilized a two-stage trigger system, where the shooter "feels" a slight change in trigger force immediately prior to discharge of the weapon. Such two-stage triggers were included on a number of bolt action models such as the 1917 Enfield, 1903 Springfield, the 30-40 Kraig and the Mauser. Later versions of non-bolt action models having two-stage triggers included the M-1 Garand and the M-14.

Two-stage triggers are useful for indicating to the shooter when the weapon is about to discharge. Such indication is necessary for optimal performance in both military and civilian use. For example, a sniper or a competitive target shooter must know when the weapon is about to fire in order to stabilize the weapon for an accurate shot. Without a two-stage trigger, the shooter has no way of knowing when the weapon will discharge as the trigger is moved or pulled.

It is the purpose of this invention to provide an adapter that can be placed within the trigger housing portion of a weapon having a single-stage trigger in order to create a two-stage trigger. The adapter is easily manufactured, easily installed or removed, and requires no re-working of the weapon into which it is placed.

It is a further object of the present invention to modify a weapon without adversely affecting the inherent safety of the weapon resulting from a large sear surface engagement between the trigger and the hammer.

SUMMARY OF THE INVENTION

It is an object of this invention to provide an adjustable adapter to be inserted into the trigger housing to cooperate with the trigger and hammer of a weapon with a single-stage trigger, such as an M-16 or AR-15 rifle, that will convert the single-stage trigger system to a two-stage system. In a preferred embodiment, the adapter is small (approximately ⅝ inches in length, 5/32 inches high and 11/16 inches wide) and if manufactured from steel weighs only about ¼ ounce. The adapter comprises a first-stage ajustment screw, a positioning screw (for positioning fore and aft in the trigger housing) and, optionally, a trigger stop screw. The adapter is provided with first and second contact points, which in a preferred embodiment are planar base portions, which intersect at an obtuse angle at a fulcrum, or pivot point. Inserting the adapter into a weapon is easily accomplished by opening the weapon as for cleaning, exposing the trigger and hammer assemblies. Such assemblies can be removed by removing the hammer pin and the trigger pin. The adapter sits in a forward portion of the bottom of the trigger housing and is tensioned by the free ends of the trigger return spring. The adapter is shaped to pivot about the fulcrum when a bearing surface on the adapter is contacted by a trigger arm as the trigger is pulled. The force necessary to pull the trigger and cause the pivoting of the adapter is greater than that necessary to pull the trigger through the first stage prior to contact with the adapter.

It is an object of this invention that the adapter be applicable to weapons used for competition target shooting, S.W.A.T. team sniper guns, police, security forces and military applications, or in any environment wherein accuracy and safe operation is required.

DETAILED DESCRIPTION OF THE INVENTION

Figure 1:
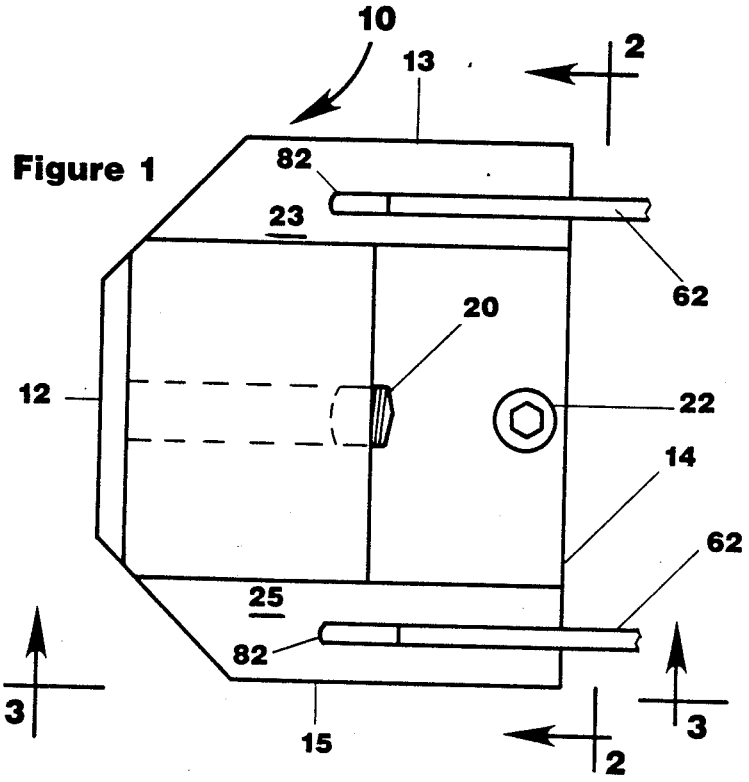
FIG. 1 is a plan view of the apparatus of the present invention.
Figure 2:
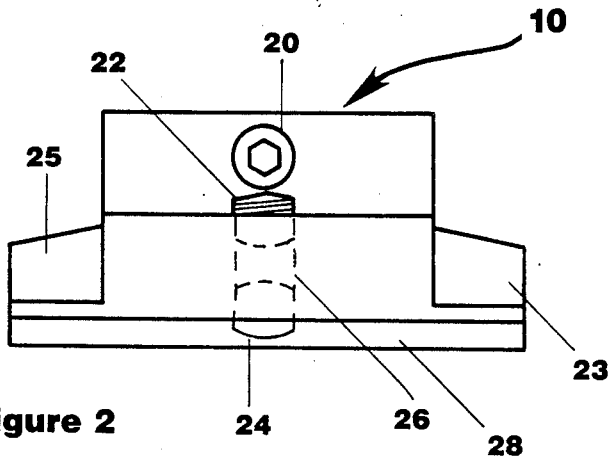
FIG. 2 is an end view taken along lines 2—2 of FIG. 1.

Referring to the figures, the adapter 10 is provided with a forward edge portion 12, a rearward edge section 14 and side edge portions 13, 15. The adapter may be provided with a plurality of adjustment means to properly position the adapter for use. An upper portion 17 is provided with a positioning screw 20, and a lower portion 19 is provided with adjusting screw 22 and a trigger stop screw 24. Preferably, each of the adjustment means is threadably engaged in the adapter 10. The adjusting screw 22 is provided in bearing surface 21. The bottom of the device is arranged to pivot about a fulcrum, or pivot point, 30; a first contact portion in the form of a planar base member 16 and a second contact portion in the form of a planar base member 28 are arranged about fulcrum 30 in an inclusive obtuse angle "A". The adjusting screw 22 and stop screw 24 thread into aperture 26 through lower portion 19, while positioning screw 20 threads into positioning aperture 34 in upper portion 17. The device is further provided with lateral engaging surfaces 23, 25 extending substantially from the forward edge portion 12 to the rearward edge portion 14 of adapter 10.

Figure 7:
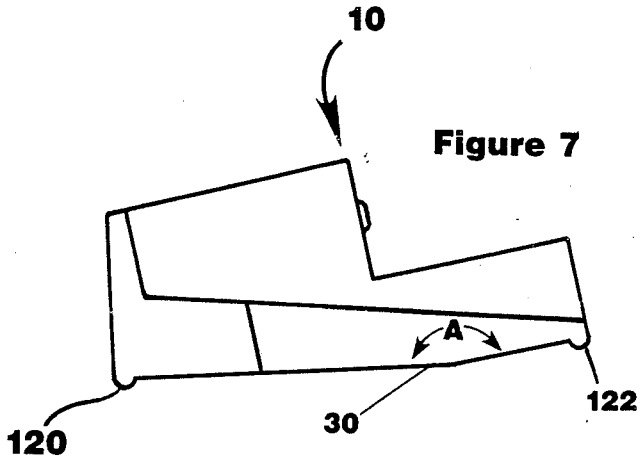
FIG. 7 is a side elevation view of an alternative embodiment of the present invention.

It is to be understood that the device is preferably provided with planar base members 16, 28. However, as illustrated in FIG. 7, the contact portions may be points 120, 122 rather than planar surfaces 16, 28. In either case, the contact portions must be arranged at an obtuse angle "A" to one another relative to the pivot point 30.

Figure 5:
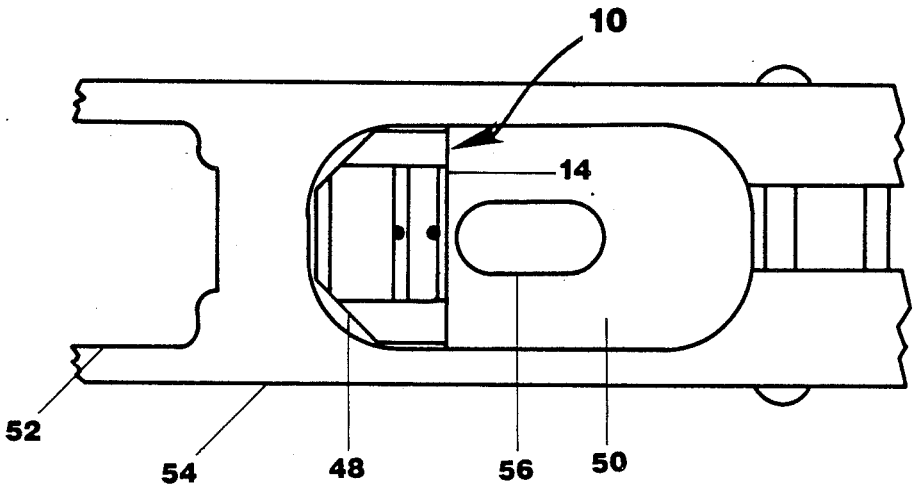
FIG. 5 is a perspective view of the apparatus of the present invention installed in a trigger housing.

FIG. 5 illustrates the position of adapter 10 within a forward portion 48 of trigger housing 50, located behind the magazine well 52 of the lower receiver 54. The rearward edge portion 14 of adapter 10 is adjacent trigger aperture 56. The width of the trigger housing 50 is marginally wider than adapter 10, so that the adapter 10 remains laterally centered in the trigger housing 50.

Figure 6:
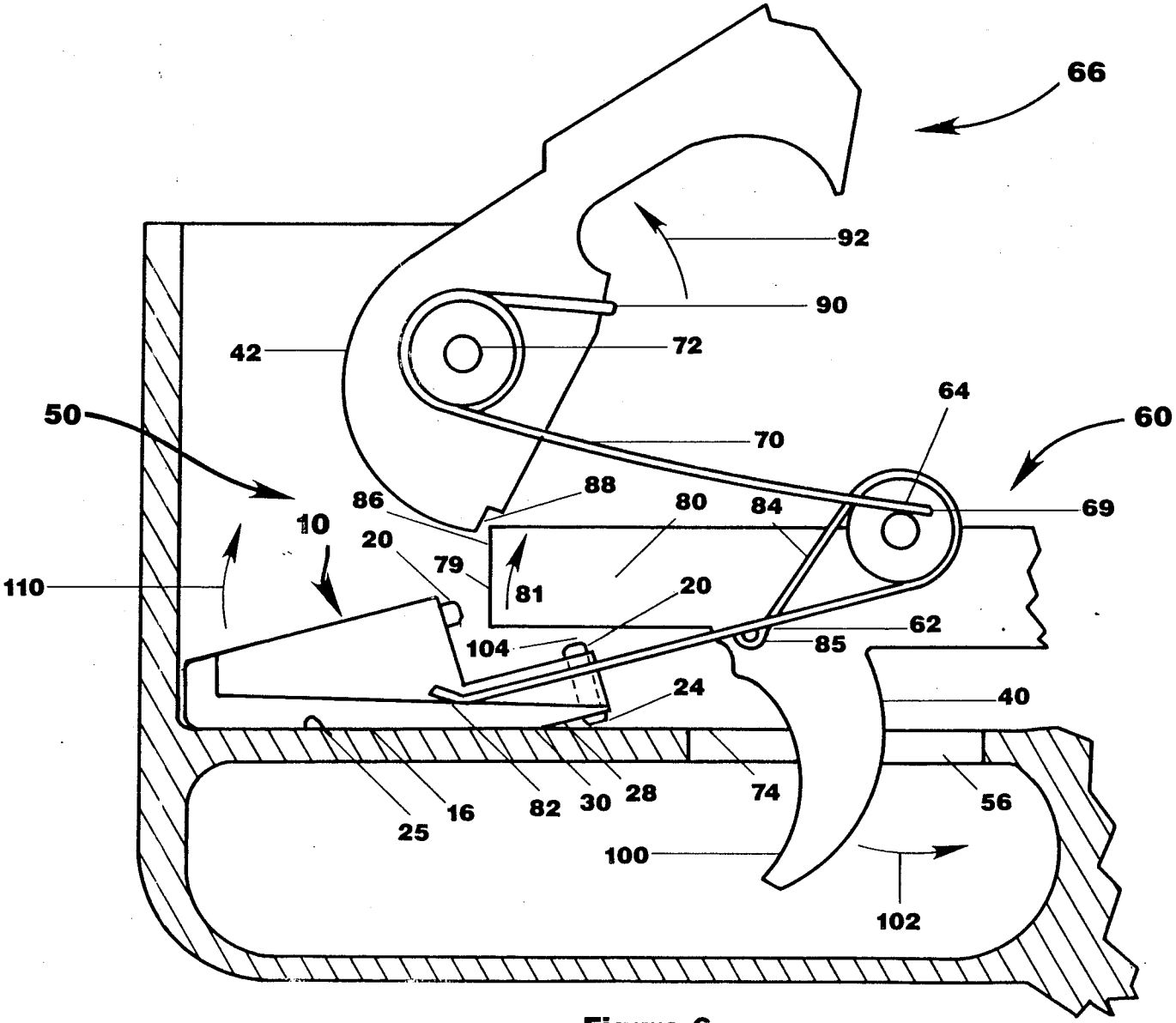
FIG. 6 is a sectional view of the apparatus of the present invention installed in a trigger housing.

FIG. 6 illustrates the cooperation of the adapter of the present invention with the trigger and hammer contained within the trigger housing 50. The trigger assembly 60 comprises trigger 40, trigger spring 62, and trigger arm 80, all of which pivot about trigger pin 64. Hammer assembly 66 comprises hammer 42 and hammer spring 70 pivoting about hammer pin 72. The adapter 10 is positioned on the bottom 74 of trigger housing 50 with the first planar base member 16 in engagement with bottom 74 in a first base contact position. The second planar base member 28 and trigger stop screw 24 are in a raised position not contacting bottom 74. The trigger arm 80 has not yet contacted the adjusting screw 22.

In the first-stage "cocked" position of FIG. 6, the first free ends 82 of the torsion trigger spring 62 bear against the lateral engaging surfaces 23, 25, thereby producing a downward force on the adapter 10 to maintain the first planar base member 16 in engagement with bottom 74 in the first base contact position. The second end 84 of trigger spring 62 opposite end 82 is affixed to the underside of trigger arm 80 at 85. Similarly, first end 69 of hammer spring 70 rests on the trigger pin 64, with a second end 90 secured about hammer 42. The interaction of spring 62 and spring 70 loads the trigger arm 80 in direction of arrow 81 and the hammer in the direction of arrow 92. The trigger arm 80 is provided with trigger sear surface 86 while the hammer is provided with hammer sear surface 88. The sear surfaces 86, 88 are frictionally engaged (and resist disengagement) when in this "cocked" or ready-to-fire position of FIG. 6.

As the trigger 40 is slowly pulled in the direction of arrow 102, the gap 104 between trigger arm 80 and the adjusting screw 22 is narrowed. When the sear surfaces 86, 88 are engaged, the trigger force required to pull the trigger is a combination of the friction force between sear surfaces 86, 88 and the resisting trigger spring 62. Prior to the trigger arm 80 contacting the adapter 10, the trigger is proceeding through a "first stage", wherein the trigger pull force is about 5 pounds. Continued pull of trigger 40 causes the trigger arm 80 to contact the adjusting screw 22, wherein the trigger is being pulled through the "second-stage". There is at this point a slight but discernible increased pull force required to continue moving the trigger 40. The increased second stage pull force occurs because the trigger arm 80 causes downward motion of adjusting screw 22, and causes the adapter to rotate in the direction of arrow 110 about fulcrum 30. Rotation around fulcrum 30 causes the first planar base 16 of adapter 10 to raise off of bottom 74, and causes the second planar base member 28 to approach contact with bottom 74, into what is termed the second base contact position. As the trigger arm 80 continues to bear down against adjusting screw 22, it is resisted by the coiled spring 62 bearing on lateral engaging surfaces 23, 25, tending to maintain the adapter in the first base contact 16 position of FIG. 6. The raising of surfaces 23, 25 causes spring 62 to further coil, resulting in a larger torque around pin 64 and consequently a slightly harder pull on trigger 40. After sufficient rotation of trigger arm 80, the sear surfaces 86 and 88 disengage and hammer 68 rotates in the direction of arrow 92 to strike the firing pin (not shown). Trigger stop screw 24 can be adjusted to limit the travel of trigger arm 80 and trigger 40 after the hammer is released. Minimal travel of trigger 40 is desirable after firing in a weapon requiring accuracy.

Positioning screw 20 is adjustable to bear against the end 79 of trigger arm 80 as necessary to maintain the adapter 10 in the proper position within trigger section 50.

The trigger pull force of the trigger (while surfaces 16 and 74 are in contact) is about 5 pounds. Once the trigger arm 80 has contacted pin 22 and caused adapter 10 to rotate about fulcrum 30 from a first contact position (to a second base contact portion with surface 28 in contact with bottom 74) the second stage trigger pull force increases to about 7–8 pounds (in an AR-15 A2). A trained shooter is easily capable of determining the engagement of trigger arm 80 and pin 22 to initiate the second stage, and is therefore forewarned that the sear surfaces 86, 88 are about to disengage. This "warning" enables the shooter to further steady the rifle for an accurate shot.

In another embodiment, one or more of the adjusting screws 20, 22, 24 can be eliminated by precisely manufacturing of the adapter to interfit within the intended recipient rifle. However, such precision is not necessary when the adapter is provided with the adjusting screws 20, 22, 24, thereby making the adapter adaptable to different weapon configurations and/or manufacturing tolerances.

Figure 3:
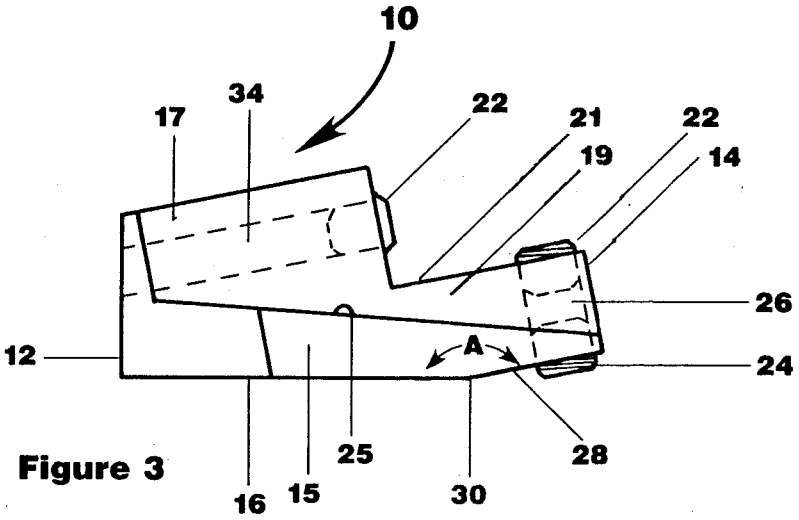
FIG. 3 is a side elevation view taken along lines 3—3 of FIG. 1.
Figure 4B:
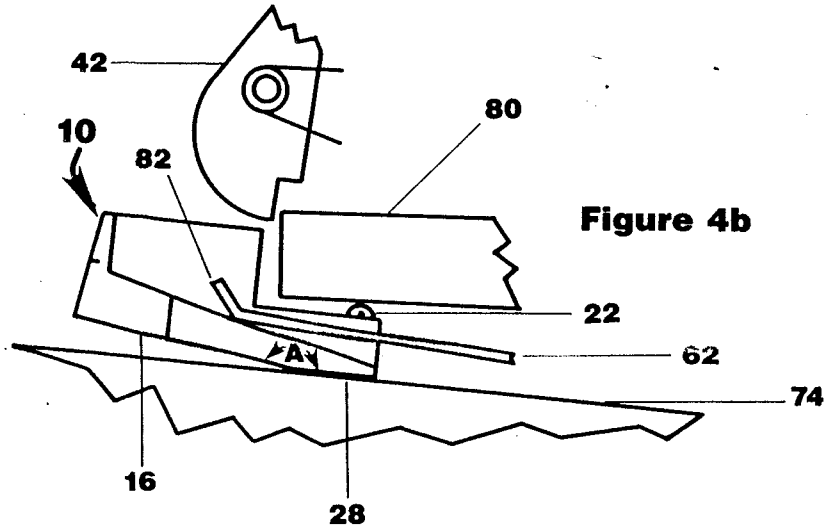
FIGS. 4*a* and 4*b* illustrate the first and second stage trigger position.
Figure 4A:
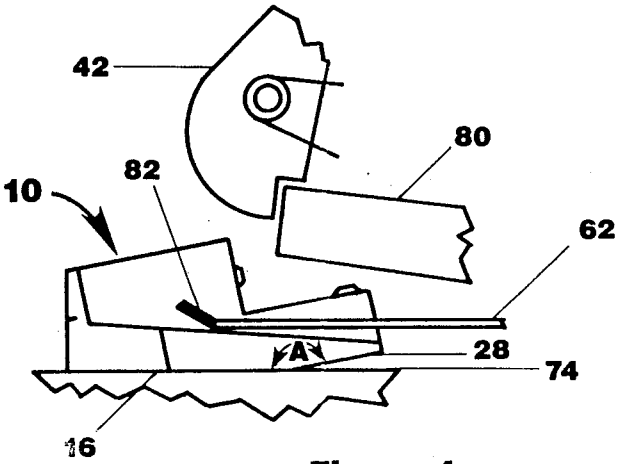

While a preferred embodiment of the invention has been disclosed as, for example in FIG. 3, various modes of carrying out the principles disclosed herein are contemplated as being within the scope of the following claims, such as the embodiment of FIG. 7. Therefore, it is understood that the scope of the invention is not to be limited except as otherwise set forth in the claims.

I claim:

1. An adapter to convert a single-stage trigger to a two-stage trigger in a weapon, comprising:

a. a first base contact portion and a second base contact portion arranged at an inclusive obtuse angle to one another such that the bases intersect at a fulcrum; and b. a bearing surface to contact a trigger arm such that engagement of the bearing surface and the trigger arm causes the adapter to pivot about the fulcrum from a first base contact position to a second base contact position.

2. The adapter as recited in claim 1, wherein the first contact portion and the second contact portion comprise planar base members.

3. The adapter as recited in claim 2, further comprising:

a. an adjusting screw in the bearing surface;

b. a trigger stop screw in the planar second base member; and c. a positioning screw in an aperture parallel to the planar first base member.

4. The adapter as recited in claim 1, wherein the adapter is manufactured of steel.

5. A two-stage trigger comprising:

a. a trigger having a trigger arm pivoting about a pin defining a pivot point;

b. a trigger spring pivotally affixed to the pin;

c. an adapter having first and second contact portions arranged at an inclusive obtuse angle to one another and intersecting at a pivot point, said first contact portion maintained in a first base contact position, and an upper bearing surface contacted by the trigger arm, such that the adapter pivots about the fulcrum from the first base contact position to a second base contact position when the trigger arm bears against the upper bearing surface.

6. The two-stage trigger of claim 5, wherein the first and second contact portions comprise planar base members.

7. The two-stage trigger of claim 5, wherein the adapter is provided with an adjusting means, a trigger stop means and a positioning means.

8. The two-stage trigger of claim 5, wherein the trigger spring bears against the adapter to tension adapter to the first contact position.

9. The two-stage trigger of claim 5, wherein when the trigger is in a first stage the first contact portion is in a first contact position and when the trigger is in a second stage the second contact portion is in a second contact position.

10. The two-stage trigger of claim 9, wherein the trigger requires a greater force to pull through the second stage than through the first stage.

* * * * *